United States Patent [19]

Fontana

[11] 4,023,767

[45] May 17, 1977

[54] MOLD BOX AND MOLD HEAD

[76] Inventor: Joseph R. Fontana, 2130 Broadway Ave., Pittsburgh, Pa. 15216

[22] Filed: June 15, 1976

[21] Appl. No.: 666,064

[52] U.S. Cl. ..... 249/52; 249/119; 249/122; 249/129

[51] Int. Cl.[2] ..... B28B 7/20

[58] Field of Search ..... 249/52, 60, 117, 119, 249/122, 123, 129

[56] References Cited

UNITED STATES PATENTS

| | | | |
|---|---|---|---|
| 511,098 | 12/1893 | Schultz | 249/52 |
| 720,536 | 2/1903 | Seamons | 249/122 X |
| 804,423 | 11/1905 | Miller | 249/122 X |
| 1,407,614 | 2/1922 | Wicks | 249/129 X |
| 1,907,503 | 5/1933 | Chilton | 249/52 |
| 1,925,733 | 9/1933 | Pandolfi | 249/119 |
| 1,981,203 | 11/1934 | Siems | 249/122 |
| 2,146,678 | 2/1939 | Jung | 249/52 X |
| 2,896,299 | 7/1959 | Heinb | 249/52 |
| 3,158,919 | 12/1964 | Audia | 249/129 X |
| 3,341,167 | 9/1967 | Weiss | 249/119 X |

*Primary Examiner*—J. Howard Flint, Jr.

[57] ABSTRACT

A mold box and mold head that are interfitted together to mold concrete blocks. The mold box has two sides and two ends forming a continuous flange around it and two laterally spaced partitions equally spaced between the two ends, one partition being in the form of a straight bar, and the other, in the form of three spaced boss members. Upwardly-extending bosses that are generally plate-like are fixed to rods which extend across laterally, parallel to the ends. The head is made up of a plate-like member having spaced plate-like members attached to it. The spaced plate-like members cooperate with the partitions in the mold box to form a concrete block therein. The resulting block is tongued on one side and grooved on the other and the top is tongued and the bottom grooved for interlocking purposes. The interior section contains three rows of cells providing greater insulation and saving of material.

4 Claims, 7 Drawing Figures

MOLD BOX AND MOLD HEAD

OBJECTS OF THE INVENTION

It is an object of the invention to provide an improved mold box.

Another object of the invention is to provide a mold box that is simple in construction, economical to manufacture and simple and efficient to use.

Another object of the invention is to provide a mold box for interlocking blocks.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

DETAILED DESCRIPTION OF THE DRAWINGS

Figure 1:
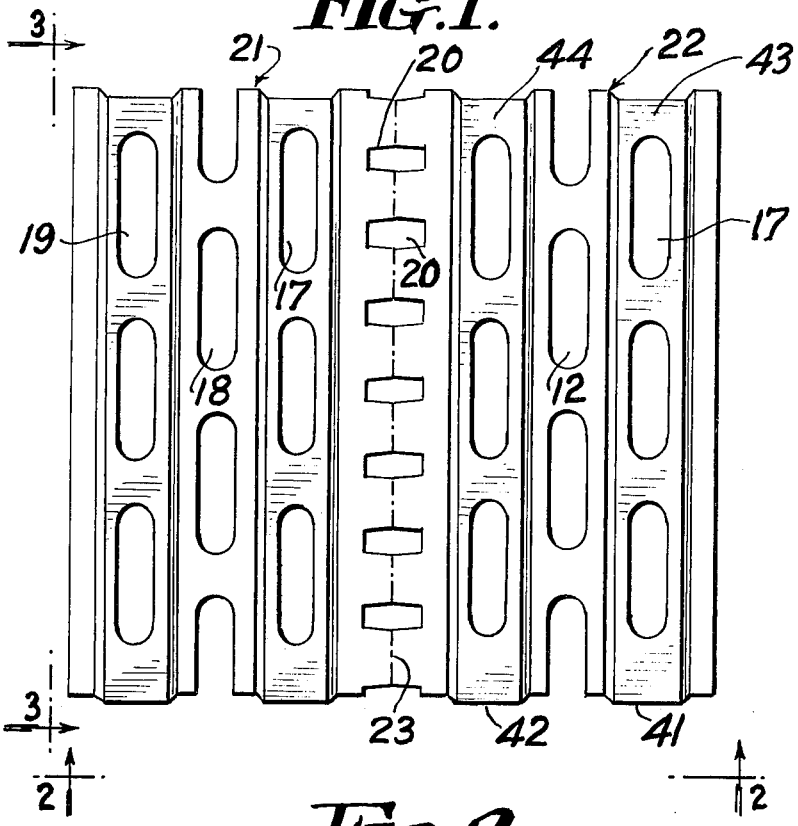
FIG. 1 is a top view of two concrete blocks fixed together siamese-like that were made in the mold box shown herein.
Figure 2:
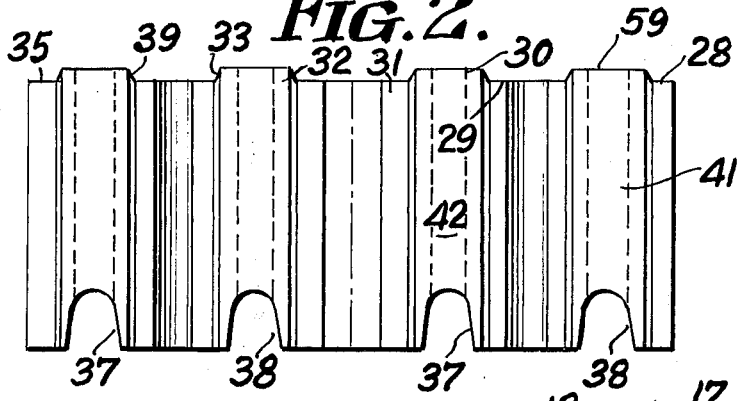
FIG. 2 is an end view of the box shown in FIG. 1.
Figure 3:
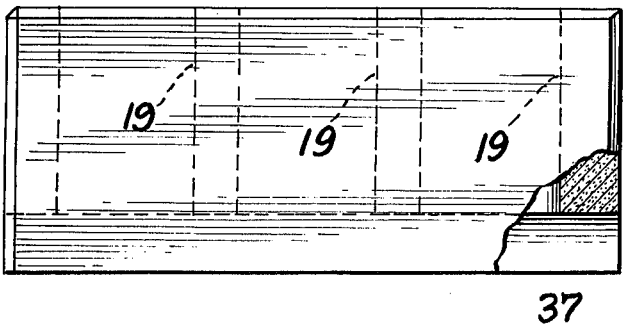
FIG. 3 is a side view of the box shown in FIG. 2.
Figure 4:
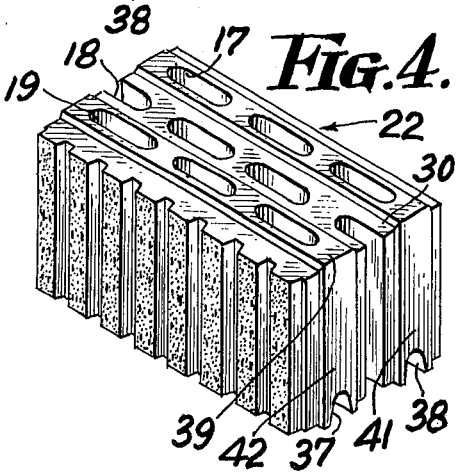
FIG. 4 is an isometric view of a single block constituting half of the block as shown in FIG. 1.
Figure 5:
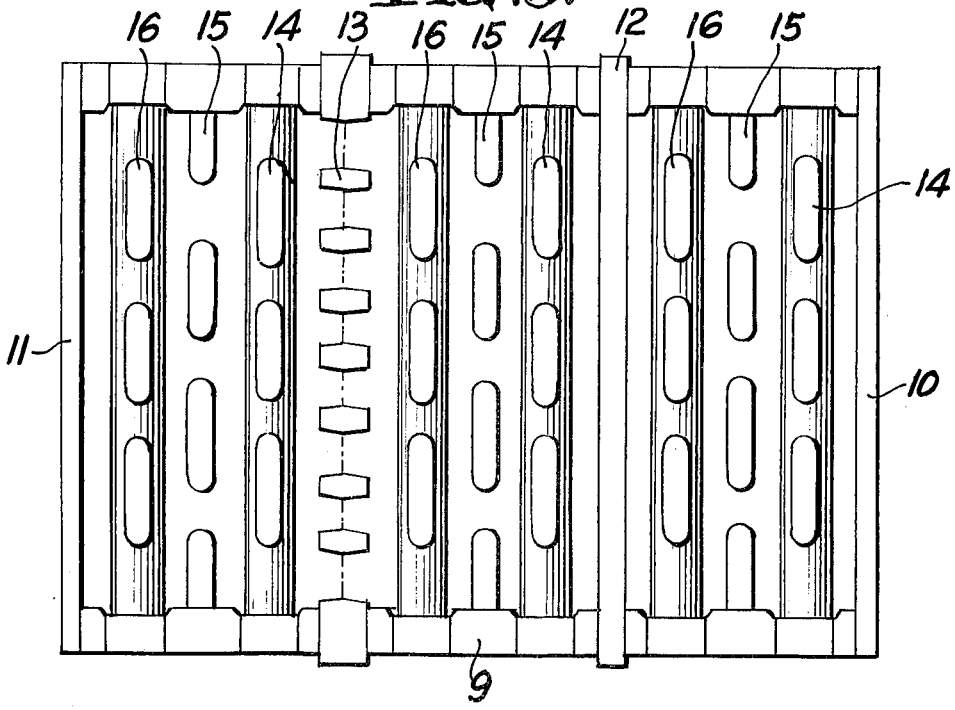
FIG. 5 is a bottom view of the mold box.
Figure 6:
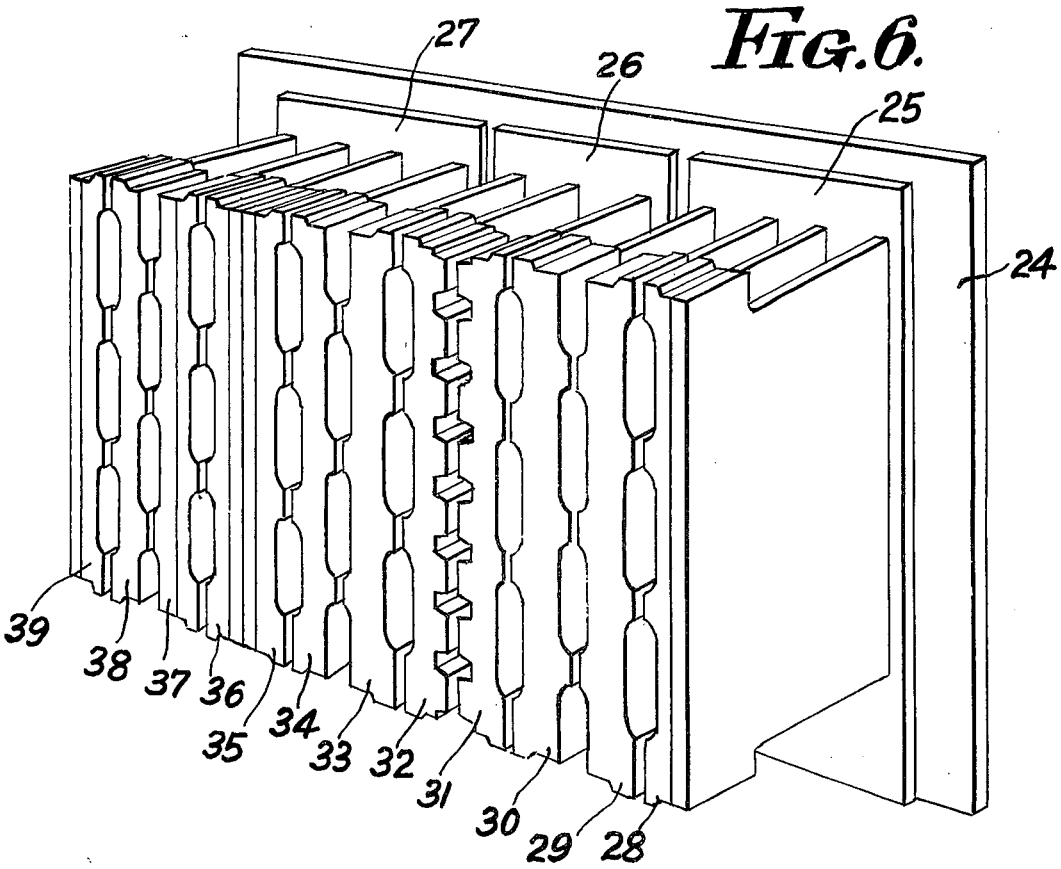
FIG. 6 is an isometric view of the mold box head.
Figure 7:
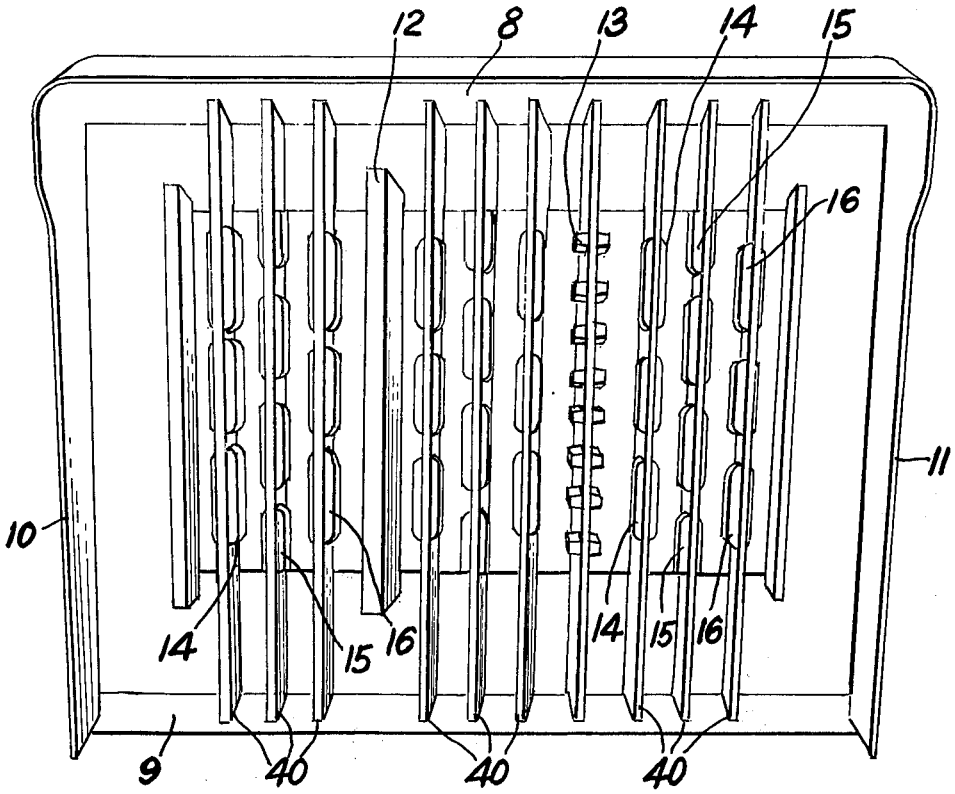
FIG. 7 is a top view of the mold box.

Now, with more particular reference to the drawings, the block shown in FIGS. 1–4 are made in the mold box head shown in FIGS. 5, 6 and 7.

The mold box shown in FIGS. 5, 6 and 7 has the sides 8 and 9 generally parallel to each other and connected together by ends 10 and 11, forming a rectangular enclosure. Laterally-extending longitudinally-spaced partitions 12 and 13 are provided, dividing the box into three separate compartments, each having three rows of downwardly-extending bosses 14, 15 and 16 therein. The center boss is staggered from the outer two and these bosses form the holes 17, 18 and 19 respectively and the holes 17′, 18′ and 19′ in the two halves of the box shown in FIG. 1. The spaced, generally diamond-shaped bosses 13 forming the second partition form the openings 20 between the two blocks.

The two blocks 21 and 22 can be broken along the dotted line 23, thereby separating them into two separate boxes.

The head shown in FIG. 6 has a plate 24 onto which three separate plates 25, 26 and 27 are fixed by suitable welding or other well-known fastening means. Extending from the plates 25, 26 and 27 are the ribs 28, 29, 30, 31, 32, 33, 34, 35, 36, 37, 38 and 39. These ribs extend downwardly and form the recesses 28′, 29′, 30′, 31′, 32′, 33′, 34′ and 35′.

The bottom of the mold box can be rested on a suitable supporting surface and filled with concrete of suitable mix. The head can then be lowered thereon to compress the concrete into the head and to form the block therein. The head can then be lifted off the block since the various protruding members will have suitable draft and may be coated with a suitable releaser material and the block can be removed from the mold.

Each of the depending members 28 through 39 can be fixed to the head by welding or the like and can be fabricated from suitable plates or could be cast from a single casting.

The mold box itself could be cast from a suitable casting material.

The blocks 21 and 22 can be separated by fracturing them along dotted line 23. The blocks thus separated will have tongued side with grooves 37 and 38 and tongues 30 and 38. The ends will have tongues 40 and 41 and grooves 43 and 44.

The cells 17, 18 and 19 and 17′, 18′ and 19′ provide insulation and save material.

The foregoing specification sets forth the invention in its preferred practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A mold box and head combination comprising, a mold having spaced sides and ends defining a rectangular enclosure, a bottom plate, longitudinally spaced partions attached to said plate and extending across said mold box, vertically-extending core members fixed to said mold box bottom plate and extending upwardly therefrom for forming elongated cells in blocks, said core members being generally plate-like members having rounded ends, one said partition being made of spaced, generally diamond-shaped members fixed to said mold box and extending upwardly therefrom whereby two said blocks in concrete can be made together and fractured along a line defined by the spaces between said diamond-shaped partition members, thereby providing a fluted face on one side of said block.

2. The mold box recited in claim 1 wherein the other said partition is a flat, plate-like member.

3. The mold box recited in claim 1 wherein said mold box has a head thereon and said head has elongated ridges thereon extending generally parallel to said partitions for forming grooves in blocks between upwardly-extending tongues therein, said tongues being disposed in alignment with said cells.

4. The mold box recited in claim 1 wherein said core box members are connected to a plate.

* * * * *